US005611179A

United States Patent [19]

Leek

[11] Patent Number: 5,611,179

[45] Date of Patent: Mar. 18, 1997

[54] ADJUSTABLE FOUNDATION PLATE

[75] Inventor: William F. Leek, Anaheim, Calif.

[73] Assignee: Simpson Strong-Tie Company, Inc., Pleasanton, Calif.

[21] Appl. No.: 601,426

[22] Filed: Feb. 12, 1996

[51] Int. Cl.[6] ..... E04B 1/38

[52] U.S. Cl. ..... 52/293.3; 52/250; 52/274; 52/713; 52/715; 403/13

[58] Field of Search ..... 52/250, 264, 274, 52/293.1, 293.3, 294, 712, 713, 715; 403/11, 12, 13, 14

[56] References Cited

U.S. PATENT DOCUMENTS

| | | | |
|---|---|---|---|
| 1,971,200 | 8/1934 | Proctor et al. | 403/14 |
| 2,165,336 | 7/1939 | Brogden | 52/274 X |
| 2,686,700 | 8/1954 | McCarran | 403/409.1 X |
| 3,205,981 | 9/1965 | Lilly | 403/11 |
| 3,479,071 | 11/1969 | Downing | 52/713 X |
| 3,842,554 | 10/1974 | Swick | 52/264 X |
| 4,030,378 | 6/1977 | Kroesser | 403/11 X |
| 5,513,476 | 5/1996 | Jones | 52/293.3 X |

FOREIGN PATENT DOCUMENTS

| | | | |
|---|---|---|---|
| 2639552 | 3/1978 | Germany | 52/713 |
| 2643365 | 3/1978 | Germany | 52/713 |

*Primary Examiner*—Carl D. Friedman
*Assistant Examiner*—Kevin D. Wilkens
*Attorney, Agent, or Firm*—James R. Cypher

[57] ABSTRACT

An adjustable foundation-to-frame member connection including a foundation, a frame member and an adjustable foundation plate connector attached to the foundation and frame member by a frame fastener member and foundation fastener member. The adjustable foundation-to-frame member connection being easily formed and adaptable to a wide variety of installation dimensions, including those where the frame member overhangs the side face of the foundation and is not in alignment with the side face of the foundation. The foundation plate connector includes a foundation attachment member, having foundation attachment openings, guide members, and an elongated openings, releasably connected to a frame attachment member, having frame member attachment openings and a staircase openings, by a held-holding fastener and a holding member attached thereto.

9 Claims, 9 Drawing Sheets

ADJUSTABLE FOUNDATION PLATE

BACKGROUND OF THE INVENTION

This invention relates to a connection for attaching a mudsill or other frame member of a building structure to a foundation, by means of an adjustable foundation plate.

Earthquakes, hurricanes, tornadoes, floods or tidal action impose upward as well as lateral forces on a building structure that can lift it off its foundation. To counteract uplift and lateral forces, it has become standard practice to tie or anchor the structure to its concrete foundation.

Earthquake damage assessments show that a lack of foundation anchors is one of the two main earthquake failure modes for residential wood structures.

One of the first commercially accepted practices for anchoring a building structure to its foundation was to attach the horizontal frame member or mudsill to threaded anchor bolts embedded in the upper surface of the concrete foundation. There have been many inventions teaching improvements on this method. See U.S. Pat. No. 5,249,404, granted Oct. 5, 1993 to William F. Leek and Alfred D. Commins (patent teaching a connection formed with a metal holdown connector between the anchor bolt and a vertical frame member of the building structure). See U.S. Pat. No. 5,510,553, granted Sep. 29, 1992 to Alfred D. Commins and Ernest A. Romeo (patent teaching a connection formed with a strap that combines a holdown connector which attaches to a vertical frame member and an anchoring means which is embedded in the foundation to form a single piece for easier installation). However, these improved methods as well as the earlier method are not easily or economically adapted to connecting a completed building structure to its foundation. First, these connections require the anchor to be set when the foundation is poured. Secondly, they call for an anchor that protrudes from the upper surface of the foundation which is best installed before the building structure is constructed on the foundation.

The purpose of the present invention is to easily and economically form a strong connection between a frame member of a completed building structure and the foundation on which it rests.

Retrofit work imposes two major difficulties on the builder. The builder must add the connection to an existing structure and he must work in what is very often a cramped space underneath the building structure. The ease with which this connection can be formed despite these difficulties is important to its economic success, and, in fact, the ease of installation of the connection may be determinative as to whether the retrofit work will be done at all. This is especially true for crawl space foundations, where it is not uncommon that the installer will find himself slithering around on his belly in the dirt amid the black widow spiders and every imaginable type of refuse left by the workman who built the original house, including nails, screws, glass, pieces of wire, stones, pieces of concrete, and pieces of plasterboard.

The first specific problem in such retrofit work is that access to the top face of the foundation is restricted since the frame member sits on it and there is usually little clearance between other members of the building structure, such as floor joists, and the top face of the foundation. Thus there is a great need for methods for retrofitting that allow the workman to install the anchoring means to the exposed side face of the foundation rather than the top face of the foundation.

Secondly, the dimensions of frame members and foundations are rarely uniform. The width of the frame member and the width of the foundation will vary. While it is usual to expect that the frame member, such as the mudsill, will be thinner than the foundation, it is not uncommon to find structures where the mudsill member is wider than the foundation and overhangs the foundation.

Thirdly, it has been found that in a substantial number of buildings, the mudsill is incorrectly installed on the foundation so that it overhangs the foundation.

Fourthly, in a substantial number of foundations, the mudsill may rest totally on the foundation, but the mudsill is not parallel to the inside face of the foundation.

Fifthly, some buildings have been encountered where the mudsill not only overhangs the foundation, but also is out of alignment with the inside face of the foundation.

Thus an economically viable solution for making this connection as a retrofit, must be able to adapt easily to the differing dimensions and construction practices.

Finally, because the dimensions of frame members and foundations are variable within even a single building structure, the installer will have to individually adjust each connector to fit the dimensions of the frame member and the foundation while he is installing it in the cramped space under the building structure. This means that the adjustable foundation plate connector must be easily adapted to installations of differing dimensions.

U.S. Pat. No. 1,078,142, granted Nov. 11, 1913, to Charles Hamann, teaches a device for anchoring structures to a concrete base that can be adjusted to allow for shrinkage of the structure anchored thereby. However, U.S. Pat. No. 1,078,142 is not suitable for retrofit work as the invention teaches that the foundation fastener means should project above the top of the upper surface of the foundation.

U.S. Pat. 5,072,570, granted Dec. 17, 1991 to Michael. Johnson, teaches a method for anchoring an existing wood frame building to its foundation with elongated truss members. Requiring the use of elongated truss members limits the application of this patent to foundations where access to the frame member and foundation is unhindered. Furthermore, to accommodate installations where the side face of the frame member, such as the sill plate, does not align with the side face of the foundation member, the installer must custom fashion either an additional framing member or plate to span the distance between the elongated truss member attached to the side face of the foundation and the side face of the frame member.

A product on the market, the Harlen Retrofit Foundation System, patent pending, teaches a method for anchoring an existing wood frame building to its foundation with small, adjustable sheet metal connectors. The Harlen device achieves an adjustable connector by having two attachment members that slide in relation to each other and attach by inserting a held-holding fastener means into a discrete selected opening among a plurality of discrete openings. The fact that these openings receive the held-holding fastener means in close registration and the fact that they occur at various positions on both the frame attachment member and the foundation attachment member makes adjustment of the sheet metal connector difficult, especially when in a cramped space.

For example, in Harlen, the workman must align his top and bottom plates so that out of the twenty eight (28) openings in the upper plate, only two of them will be in alignment with two out of the six holes in the bottom plate. Fitting two bolts into the two openings which are in alignment is not too difficult when you can look down upon the top plate and can see which holes are in alignment. Consider, however, how difficult this task is when there is not enough room as illustrated in FIG. 2 to get your head between the top of the foundation 1, the subfloor 71, and the floor joists 72. In this situation, the workman cannot see which two openings are in alignment, so he must find the proper hole out of fourteen (14) different holes by actually trying them one at a time. After he finds matching holes, he must then repeat the process in the other fourteen (14) holes. Playing this adult version of a game we all played in kindergarten by a workman for several days in a dark and dirty crawl space could drive a good man to strong drink.

The Harlen device also can not be used in installations where the frame member substantially overhangs the side surface of the foundation.

SUMMARY OF THE INVENTION

The purpose of the present invention is to easily and economically form a strong connection between a frame member of a completed building structure and the foundation on which it rests.

An object of the present invention is to use an anchoring means inserted in the side face of the foundation, thus providing a strong anchor that can be easily installed.

A further object of the present invention is to use an adjustable foundation plate connector that has two separate members that can releasably attach to each other by a held-holding fastener means at selected variable points, thus accommodating applications of differing dimensions with only one form of connector.

A further object of the present invention is to achieve ease of installation to applications of variable dimensions by minimizing the motions needed to align the openings for receiving the held holding fastener that attaches the two members. In the present invention the openings that receive the held-holding fastener means are formed so that the two members need only be moved along one axis to achieve alignment of the openings. This axis is also the same along which the members slide to set the members in the proper relation to attach to the foundation and the frame member. Achieving alignment of the openings by moving along only one axis is made possible by forming the foundation attachment member with elongated openings that can receive the held-holding fastener means anywhere that the held-holding fastener means are received by the frame attachment member along the lateral axis.

A further object of the present invention is to achieve ease of installation by simplifying the process for determining where the foundation fastener means are to be set in the side face of the foundation. Because the frame attachment member and the foundation attachment member are always in general alignment no matter the dimensions of the installation, once the site for installation of the frame attachment member to the frame member is chosen, the points where holes for receiving the foundation attachment means should be drilled are easily determined. This is done by aligning the foundation attachment member with the frame attachment member using the guide means and marking the points where the foundation opening means meet the side surface of the foundation.

A further object is to make it easy for the installer to find the best station in the frame attachment member for receiving the held-holding fastener. The best station allows for the attachment of the foundation attachment member to the frame attachment member at the position where the adjustable foundation plate connector best fits the particular dimensions of the frame member in relation to the side surface of the foundation. The present invention achieves this by forming the stations for receiving the held-holding fastener at different positions along the longitudinal axis substantially along a line. Thus it is intuitive to move the held-holding fastener to a station that will result in attaching the foundation attachment member either closer to the inside edge of the frame member or farther away. This is important since in many installations the work space will be so dark and cramped that the builder will not be able to clearly see which station should be used.

Another object is to achieve ease of installation by forming the held-holding fastener means and the staircase opening means so that mechanical interlock is achieved when the held-holding fastener means is so received. Mechanical interlock allows a threaded holding means to be attached to the bolt with only one wrench.

A further object of the present invention is to allow for installations where the frame member substantially overhangs the side surface of the foundation.

A still further object of the present invention is to anchor frame members to the foundation even if the frame member is not in alignment with the side surface of the foundation.

Still another object of the present invention is to anchor mudsill anchors to foundations even though the mudsill overhangs the side surface of the foundation and the mudsill is out of alignment with the side surface of the foundation.

DESCRIPTION OF THE PREFERRED EMBODIMENT OF THE INVENTION

Figure 1:
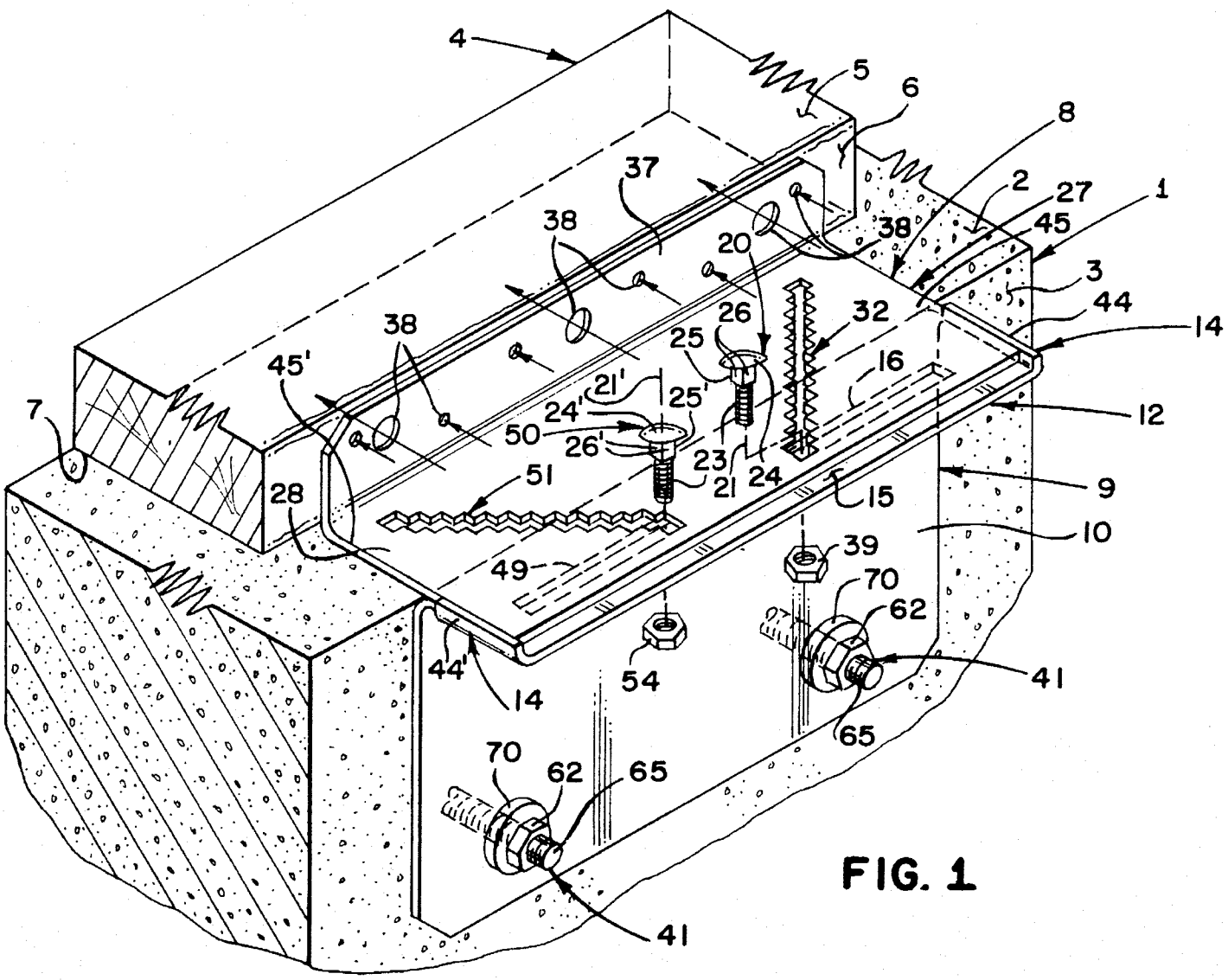
FIG. 1 is a perspective view of one form of the connection. Some of the nails and/or lag screws are omitted for clarity.
Figure 2:
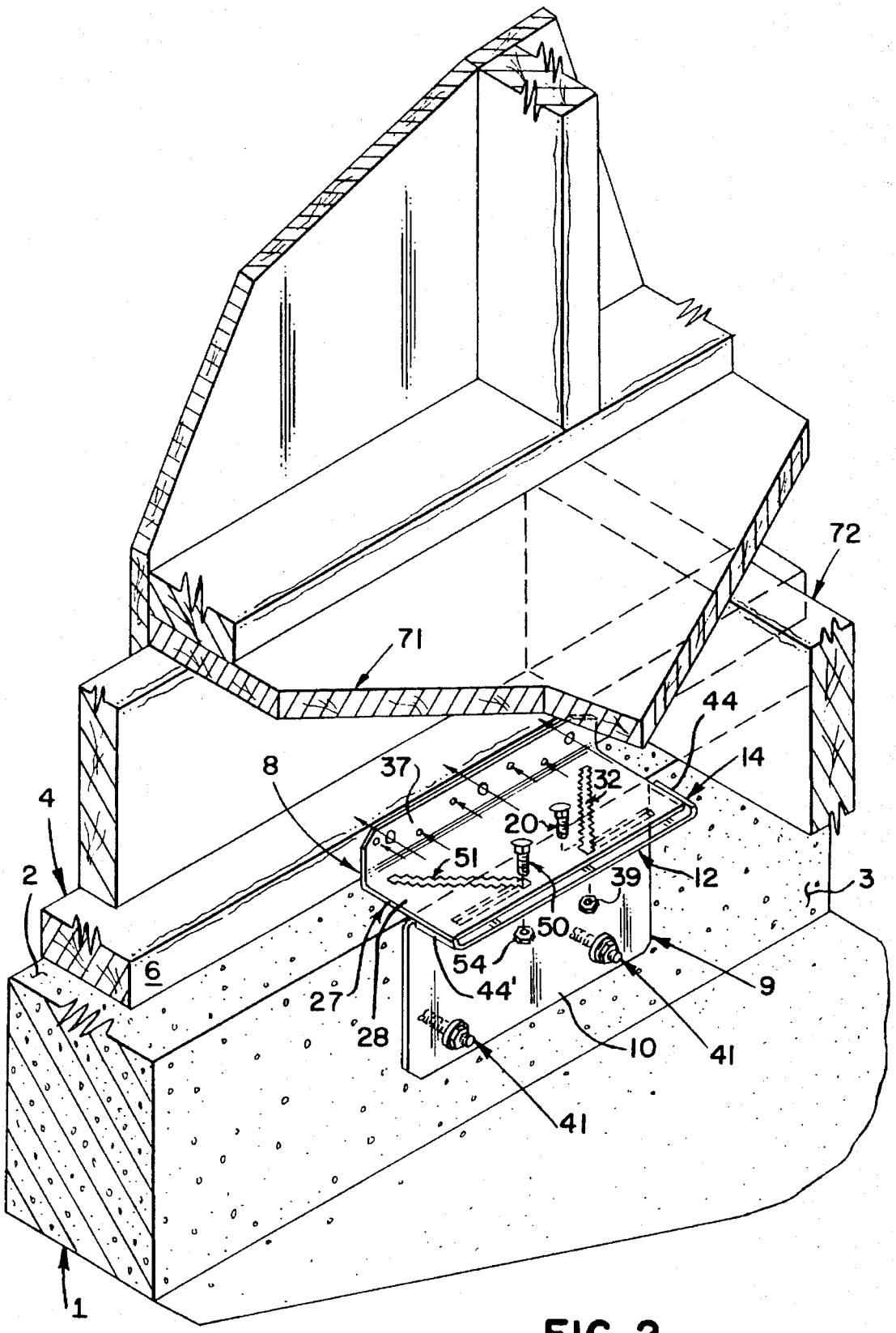
FIG. 2 is a perspective view of one form of the connection, showing the cramped space in which the device must often be installed. Some of the nails and/or lag screws are omitted for clarity.
Figure 3:
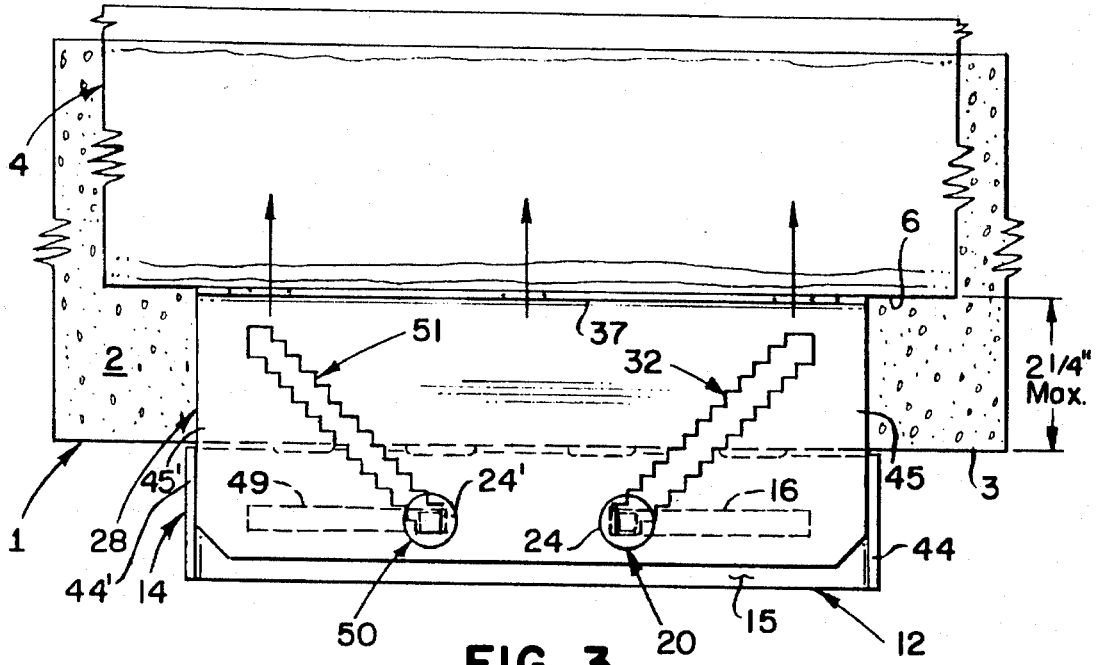
FIG. 3 is a top plan view of the connection shown in FIG. 1.
Figure 4:
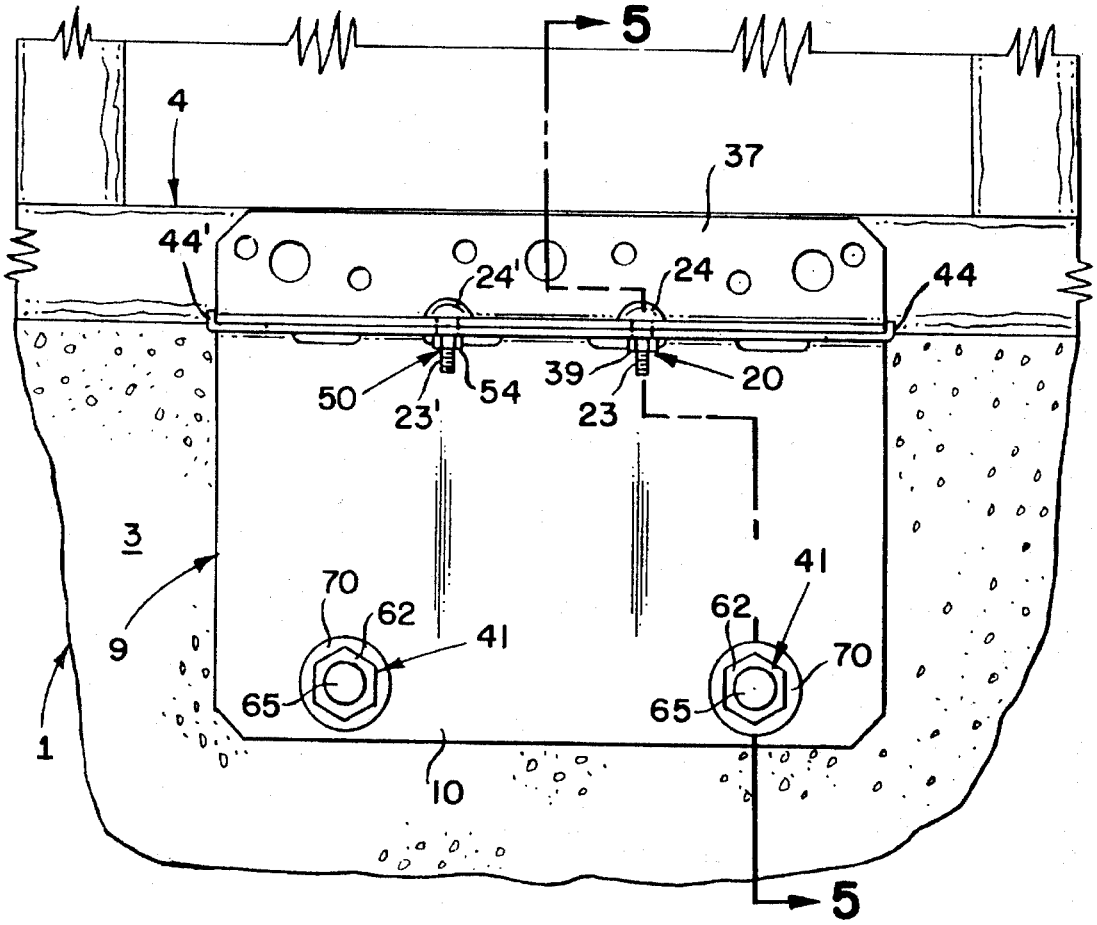
FIG. 4 is a side view of the connection shown in FIG. 1.

The present invention relates to an adjustable foundation-to-frame member connection including: a foundation 1, having an upper surface 2, and a side surface 3; a frame member 4, having an upper side 5, an inside edge 6, and a lower side 7, resting on the upper surface 2 of the foundation 1; an adjustable foundation plate connector 8, including a foundation attachment member 9 having a foundation attachment base 10 which is formed with foundation attachment opening means 11 and which is formed for substantial registration with the side surface 3 of the foundation 1, the foundation attachment member 9 having guide means 14, and a generally planar attachment flange 12 integrally connected to the foundation attachment base 10, the generally planar attachment flange 12 having a top surface 15, and an elongated opening means 16, the adjustable foundation plate connector 8 also including a held-holding fastener means 20 releasably received by the elongated opening means 16, the held-holding fastener means having a fastener axis 21, a distal-end threaded shank portion 22, a shank 23 formed with a head 24, and a head-end shank portion 25 formed with two similarly dimensioned pairs of opposing sides 26, the adjustable foundation plate connector 8 also including a frame attachment member 27 having a generally planar attachment base 28, the generally planar attachment base 28 having an attachment base lateral axis 30, an attachment base longitudinal axis 31, and a bottom surface 48, a portion of the bottom surface 48 of the generally planar attachment base 28 is in registration with the top surface 15 of the generally planar attachment flange 12, with the guide means 14 of the foundation attachment member 9 substantially aligning the frame attachment member 27 with the foundation attachment member 9 and preventing substantial displacement of the generally planar attachment base 28 in relation to the generally planar attachment flange 12 along the attachment base lateral axis 30, the generally planar attachment base 28 is also formed with a staircase opening means 32, the staircase opening means 32 formed from a series of interconnected similar stations 33, one of the similar stations 33 releasably receiving the held-holding fastener means 20 in close registration along a portion of both pairs of opposing sides 26 of the head-end shank portion 25 such that substantial rotational, lateral and longitudinal displacement between the held-holding fastener means 20 and the frame attachment member 27 is prevented, the staircase opening means 32 formed to substantially correspond in length and position along the attachment base lateral axis 30 to the length and position of the elongated opening means 16 along the attachment base lateral axis 30 when the frame attachment member 27 is received by the guide means 14 such that wherever the held-holding fastener means 20 can be received by the staircase opening means 32 along the attachment base lateral axis 30 the held-holding fastener means 20 can also be received by the elongated opening means 16 along the attachment base lateral axis 30, the staircase opening means 32 having a staircase axis 42 positioned at a selected angle 34 to the attachment base longitudinal axis 31 such that the stations 33 occur at closely-spaced, selected positions along the attachment base longitudinal axis 31, allowing for an adjustable connection of the foundation attachment member 9 to the frame attachment member 27 that can accommodate differences in the spatial relation between the side surface 3 of the foundation 1 and the inside edge 6 of the frame member 4, the frame attachment member 27 also having a frame attachment flange 37 which is integrally connected to the generally planar attachment base 28 and disposed for registration with the inside edge 6 of the frame member 4 and which is formed with frame member attachment opening means 38, the adjustable foundation plate connector 8 also including a holding means 39 releasably connected to the distal-end threaded shank portion 22 of the held-holding fastener means 20, the holding means 39 and the head 24 of the held-holding fastener means 20 formed to prevent the held-holding fastener means 20 from passing through both the elongated opening means 16 and the staircase opening means 32 when the held-holding fastener means 20 is received thereby, and the holding means 39 and the head 24 of the held-holding fastener means 20 also preventing movement of the frame attachment member 27 and the foundation attachment member 9 along the fastener axis 21; frame fastener means 40 that are received in close registration by the frame member attachment opening means 38 and secure the frame attachment member 27 to the frame member 4; and foundation fastener means 41 that are received in close registration by the foundation attachment opening means 11 and secure the foundation attachment member 9 to the foundation 1.

The adjustable foundation plate connector 8 can be constructed such that: the generally planar attachment flange 12 is formed with a second elongated opening means 49; a second held-holding fastener means 50 is included, the second held-holding fastener means 50 is releasably received by the second elongated opening means 49, the second held-holding fastener means 50 having a fastener axis 21', a distal-end threaded shank portion 22', a shank 23' formed with a head 24', and a head-end shank portion 25' formed with two similarly dimensioned pairs of opposing sides 26'; the generally planar attachment base 28 is formed with a second staircase opening means 51, the second staircase opening means 51 is formed from a series of interconnected similar stations 33', one of the similar stations 33' releasably receiving the second held-holding fastener means 50 in close registration along a portion of both pairs of opposing sides 26' of the head-end shank portion 25' such that substantial rotational, lateral and longitudinal displacement between the second held-holding fastener means 50 and the frame attachment member 27 is prevented, the second staircase opening means 51 is formed to correspond in length and position along the attachment base lateral axis 30 to the length and position of the second elongated opening means 49 along the attachment base lateral axis 30 when the frame attachment member 27 is received by the guide means 14 such that wherever the second held-holding fastener means 50 can be received by the second staircase opening means 51 along the attachment base lateral axis 30 the second held-holding fastener means 50 can also be received by the second elongated opening means 49 along the attachment base lateral axis 30, the second staircase opening means 51 having a second staircase axis 52 positioned at a selected angle 53 to the attachment base longitudinal axis 31 such that the stations 33' occur at closely-spaced, selected positions along the attachment base longitudinal axis 31, allowing for an adjustable connection of the foundation attachment member 9 to the frame attachment member 27 that can accommodate differences in the relation between the side surface 3 of the foundation 1 and the inside edge 6 of the frame member 4; and a second holding means 54 is included, the second holding means 54 releasably connected to the distal-end threaded shank portion 22' of the second held-holding fastener means 50, the second holding means 54 and the head 23' of the second held-holding fastener means 50 formed to prevent the second held-holding fastener means 50 from passing through both the second elongated opening means 49 and the second staircase opening means 51 when the second held-holding fastener means 50 is received thereby, and the second holding means 54 and the head 23' of the second held-holding fastener means 50 also preventing movement of the frame attachment member 27 and the foundation attachment member 9 along the fastener axis 21' of the second held-holding fastener means 50.

For ease of manufacture, the adjustable foundation plate connector 8 can be formed so that the guide means 14 are formed as arresting tabs 44 and 44' integrally connected to the generally planar attachment flange 12; and the generally planar attachment base 28 is formed with attachment base lateral side edges 45 and 45' dimensioned such that when a portion of the bottom surface 48 of the generally planar attachment base 28 is in registration with the top surface 15 of the generally planar attachment flange 12, the arresting tabs 44 and 44' align the frame attachment member 27 with the foundation attachment member 9 and prevent substantial displacement of the generally planar attachment base 28 in relation to the generally planar attachment flange 12 along the attachment base lateral axis 30.

In one of the preferred forms of the adjustable foundation plate connector 8 the elongated opening means 16 and the second elongated opening means 49 are formed as openings running generally parallel to the attachment base lateral axis 30, when the frame attachment member 27 is attached to the foundation attachment member 9 by the held-holding fastener means 20 and the second held-holding fastener means 50.

Figure 7:
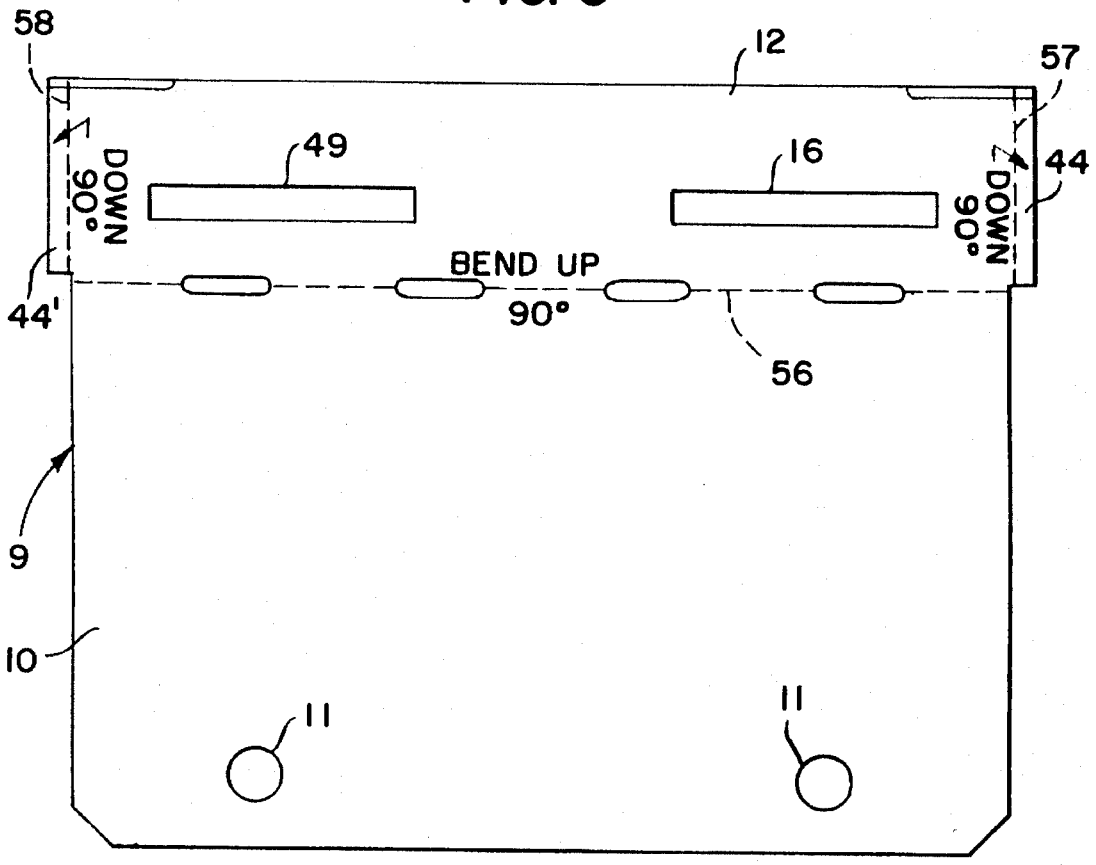
FIG. 7 is a top plan view of the foundation attachment member of the connector shown in FIG. 1 prior to its formation from the sheet metal blank.
Figure 8:
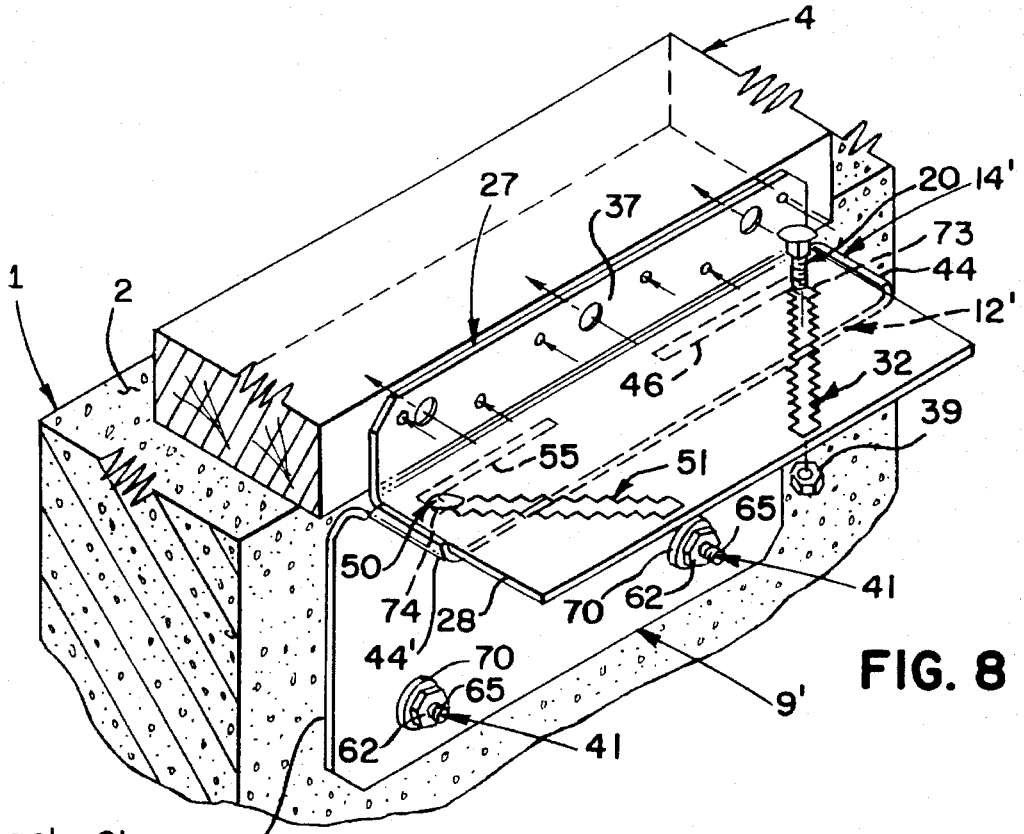
FIG. 8 is a perspective view of another form of the connection. Some of the nails and/or lag screws are omitted for clarity.
Figure 7A:
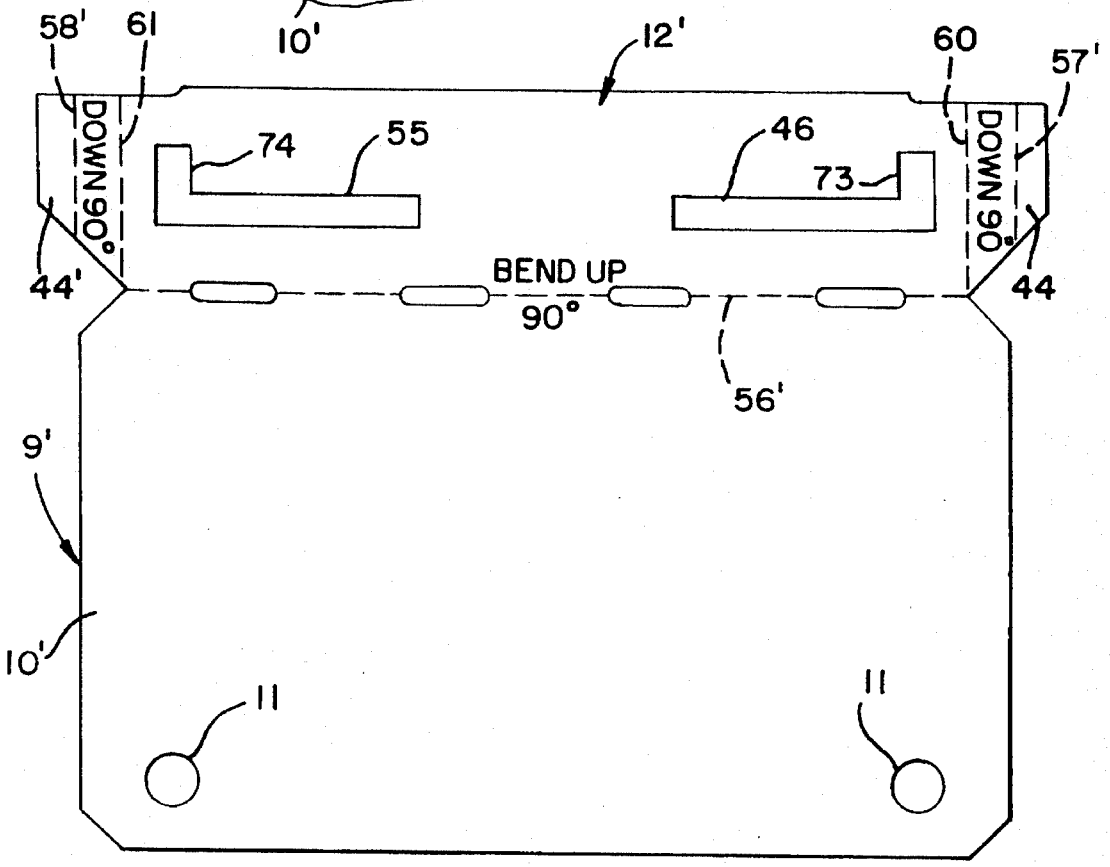
FIG. 7A is a top plan view of frame attachment member of the connector shown in FIG. 8 prior to its formation from the sheet metal blank.
Figure 9:
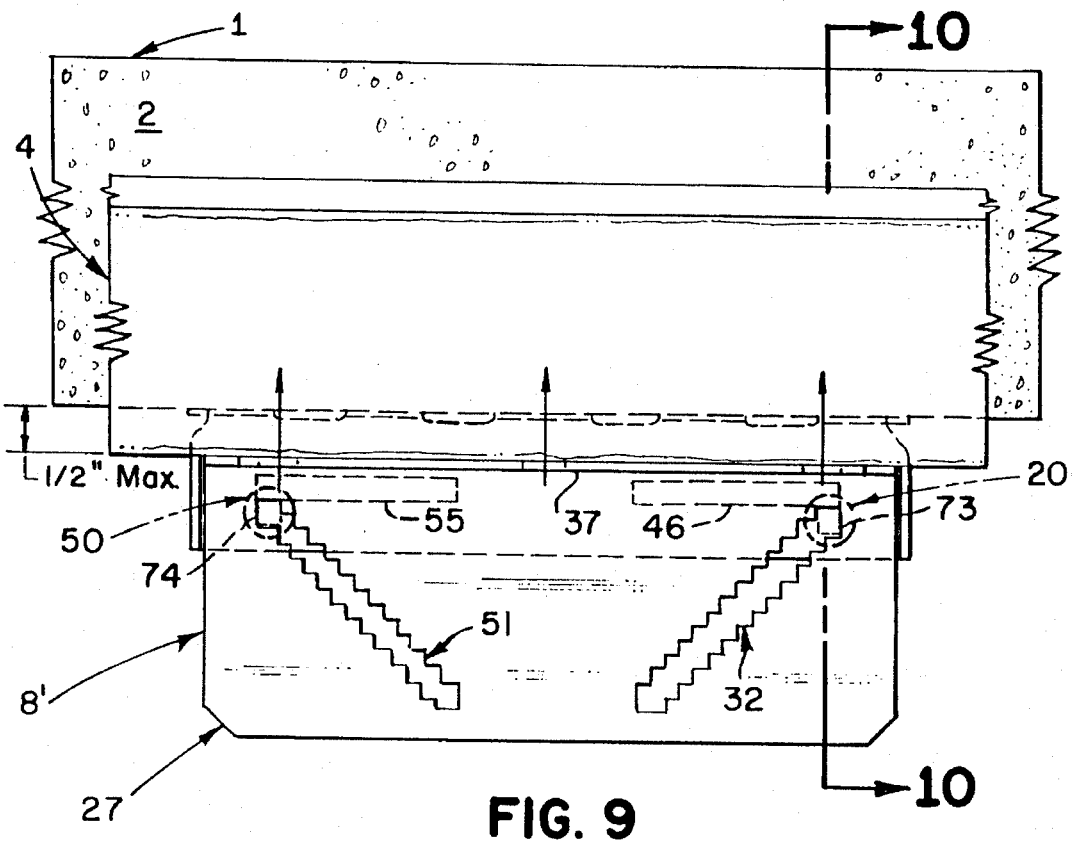
FIG. 9 is a top plan view of the connection shown in FIG. 8.
Figure 10:
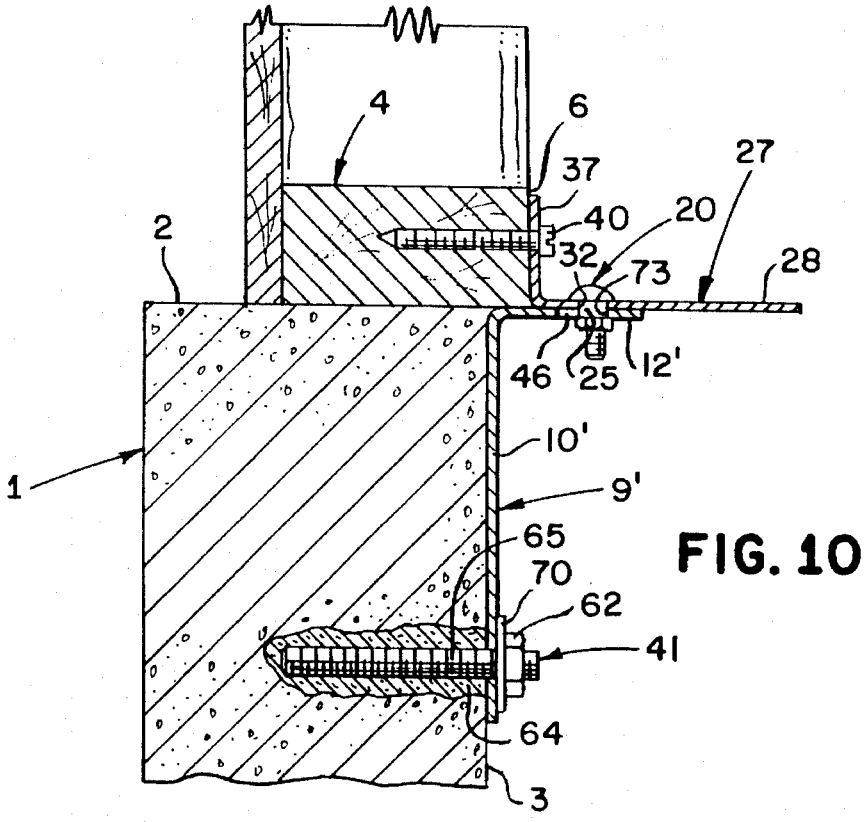
FIG. 10 is a cross sectional view of the connection shown in FIG. 8.

In another preferred form of the adjustable foundation plate connector 8', as illustrated in FIGS. 7A and 8, the elongated opening means 16 and the second elongated opening means 49 are formed as an "L"-shaped opening means 46 and a second "L"-shaped opening means 55, allowing the held-holding fastener means 20 and the second held-holding fastener means 50 to be received by leg portions 73 and 74 of "L"-shaped opening means 46 and 55 in the generally planar attachment flange 12' at a distance away from the side surface 3 of the foundation 1, thus accommodating applications where the inside edge 6 of the frame member 4 extends beyond the side surface 3 of the foundation 1.

In another preferred form, the guide means 14, lateral side edges 45 and 45', the similar stations 33, the second similar stations 33', the pairs of opposing sides 26 of the head-end shank portion 25 of the held-holding fastener means 20, and the elongated opening means 16 are formed to accommodate applications where the side surface 3 of the foundation 1 and the inside edge 6 of the frame member 4 are not in alignment.

Construction of a preferred form of the adjustable foundation plate connector 8 may be effected by reference to the blank shown in FIG. 7 of the drawings. Three bends are made in the foundation attachment member 9. At bend line 56 the foundation attachment base 10 is sharply bent up 90 degrees. At bend lines 57 & 58 the generally planar attachment flange 12 is sharply bent down 90 degrees. One bend is made in the frame attachment member 27. At bend line 59 the frame attachment member is sharply bent up 90 degrees.

Construction of the other preferred form of the adjustable foundation plate connector 8' illustrated in FIG. 8 is by forming a blank as illustrated in FIG. 7A. At bend lines 56', the foundation attachment base 10' is bent up 90 degrees. At bend lines 57' and 58', the generally planar attachment flange 12' is bent down 90 degrees. The generally planar attachment flange 12' may also be bent down slightly at bend lines 60 and 61.

The 90 degree bend along bend line 56' in the foundation attachment member 9 strengthens the connections resistance to lateral forces.

The typical applications of the present invention include: 6" to 10" foundations; stem or sloped foundations; and foundations with top or wet-set sill plates.

In the recommended installation the connections should be spaced at 2-½ ft. on center. Frame fastener means 40 should be either three (3) ⅜"×1-½" lag screws or six (6) ¼"×2-¼" wood screws. Foundation fastener means 41 should be two (2) ½" diameter epoxy bolts, penetrating the foundation 1 a minimum of 4-¼", fitted with nuts that can be threadably received by the ½" diameter epoxy bolts. The held-holding fastener means 20 and the second held-holding fastener means 50 should be ⅜"×½" carriage bolts. The holding means 39 and the second holding means 54 should be nuts that can be threadably received by ⅜"×½" carriage bolts.

The typical installation of an adjustable foundation-to-frame member connection is as follows. The frame attachment flange 37 of the frame attachment member 27 is placed against inside edge 6 of the frame member 4 and leveled. The frame attachment member 27 is fastened to the frame member 4 with frame fastener means 40. The foundation attachment member 9 is slid along the frame attachment member 27 such that guide means 14 align the two members, and the top surface 15 of the generally planar attachment flange 12 is in registration with the bottom surface 48 of the generally planar attachment base 28, and the attachment base 10 is in substantial registration with the side surface of the foundation 1. Marks are placed on the side surface 3 of the foundation 1 where openings are to be drilled in the foundation 1 with a pencil or other marking instrument, using the foundation attachment opening means 11 as guides. The foundation attachment member 9 is then removed, and openings 63 are drilled in the foundation 1 to the selected depth and width. Epoxy 64 is placed in the drilled openings and then the threaded bolt studs 65. The epoxy 64 is then given time to cure. The foundation attachment base 10 is then placed on the epoxied threaded bolt studs 65 with the foundation attachment base 10 in substantial registration with the side surface 3 of the foundation 1. The held-holding fastener means 20 and the second held-holding fastener means 50 are then placed in staircase opening means 32 and second staircase opening means 51 and elongated opening means 16 and second elongated opening means 49, making sure that the attachment base 10 remains in substantial registration with the side surface 3 of the foundation 1. Holding means 39 and second holding means 54 are then placed on the held-holding fastener means 20 and the second held-holding fastener means 50 and tightened as much as possible. As the last step, threaded nuts 62 are placed on the threaded bolt stud 65 and tightened down as much as possible, so that the foundation attachment base 10 is in substantial registration with the side surface 3 of foundation 1.

Figure 5:
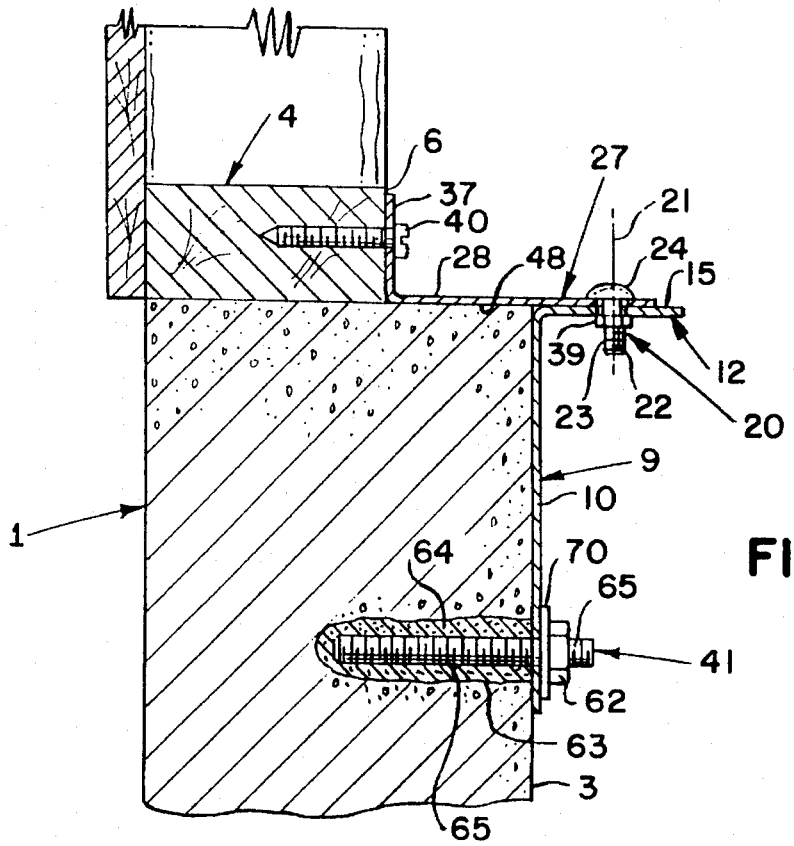
FIG. 5 is a cross sectional view of the connection shown in FIG. 4 taken along line 5—5.
Figure 5A:
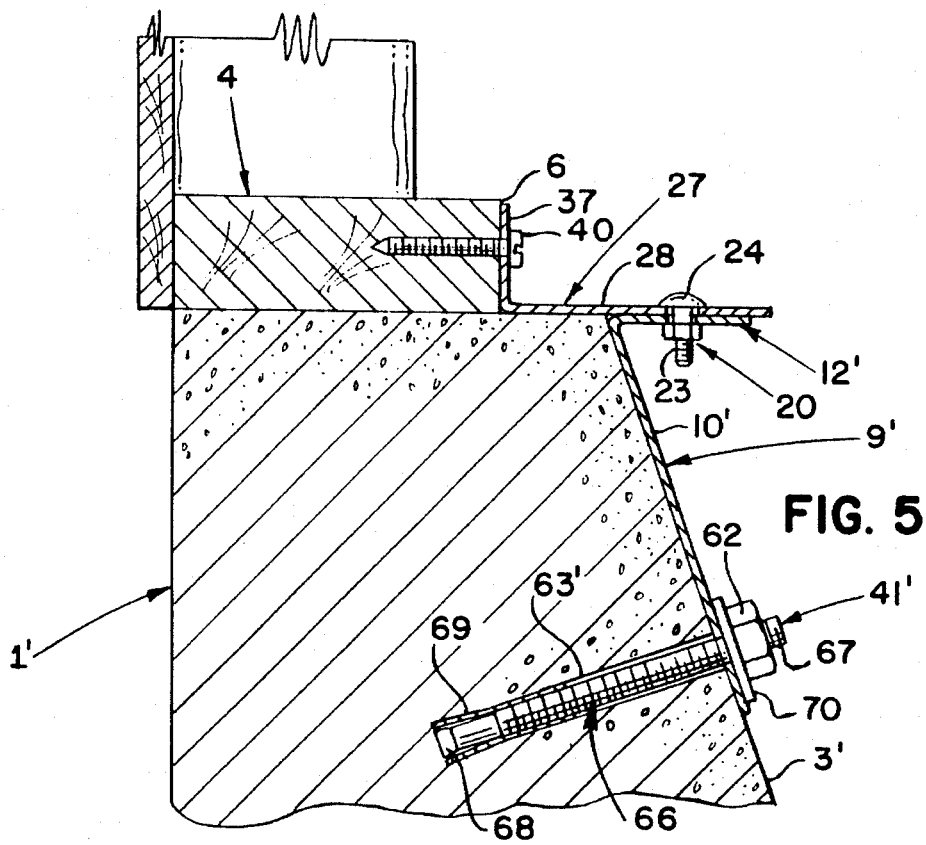
FIG. 5A is a cross sectional view of an alternate form of the connection shown in FIG. 4 in a sloped foundation taken along line 5—5.
Figure 6:
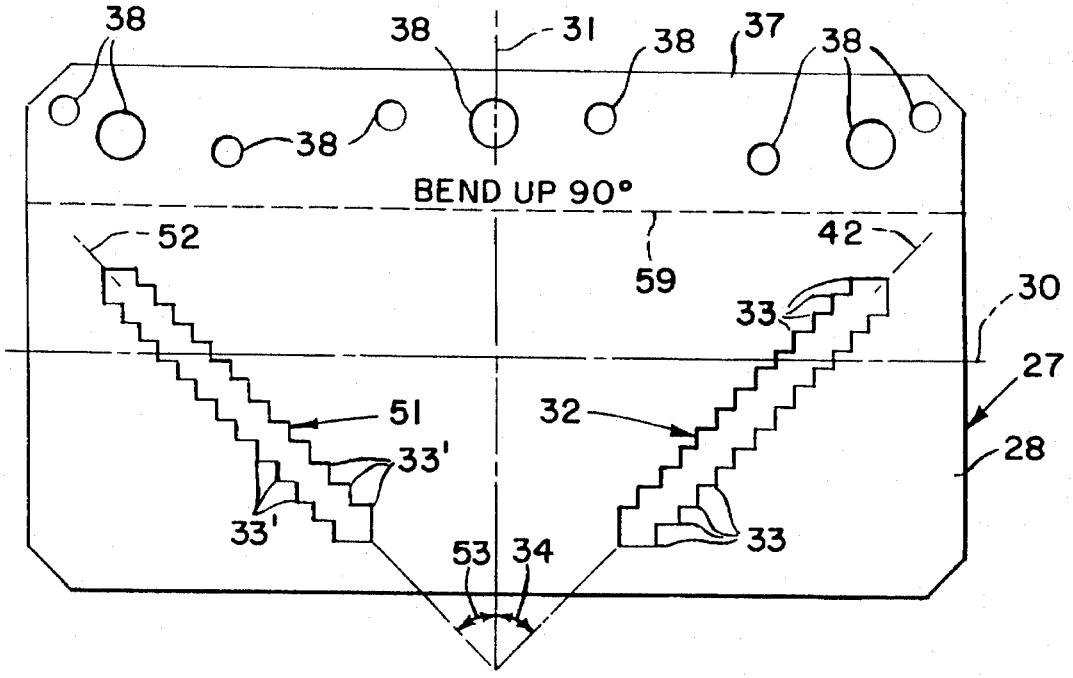
FIG. 6 is a top plan view of frame attachment member of the connector shown in FIG. 1 prior to its formation from the sheet metal blank.

FIG. 5A illustrates another method of fastening foundation attachment base 10' to foundation 1'. In this example, foundation fastener means 41' is a commercially available Redhead type fastener 66 which is installed by drilling Opening 63' in foundation 1'; hammering the Redhead type fastener 66 into opening 63'; tightening threaded nut 62 on threaded stud 67 which withdraws flared stud end 68, thereby forcing sleeve 69 into wedged interlocking frictional engagement with drilled opening 63' in foundation 1'. Placing washers 70 between threaded nuts 62 and foundation attachment base 10 and 10' is preferred.

The foundation attachment member 9 can also be made with a number of triangular bends or embossments to increase the resistance of the foundation attachment member 9 to shear forces acting on frame attachment member 27.

Figure 11:
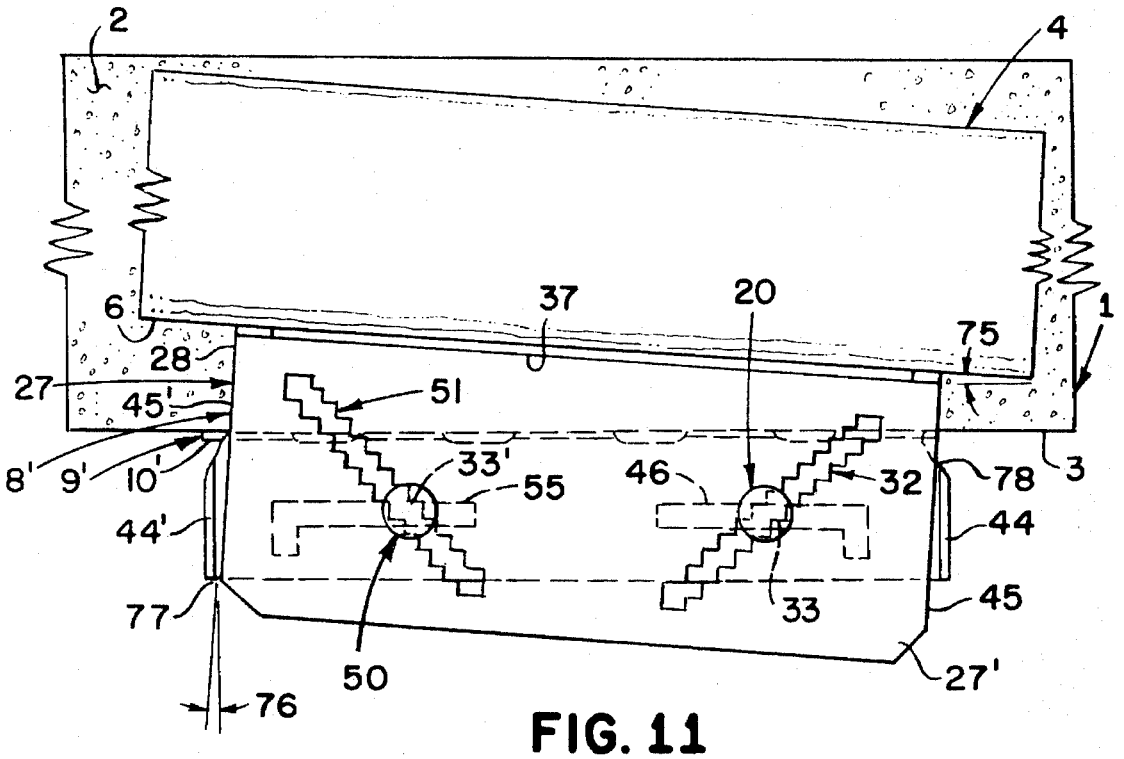
FIG. 11 is a top plan view of the connection formed when the frame member is not in alignment with the side surface of the foundation.

Referring to FIG. 11, a situation is illustrated in which the inside edge 6 of frame member 4 is out of alignment with side surface 3 of foundation 1 by an angle 75 indicated by double arrows.

In this installation, foundation adjustment base 10 of foundation attachment member 9 is attached to side surface 3 of foundation 1 as previously described and frame attachment flange 37 of frame attachment member 27 is attached to inside edge 6 of frame member 4 as previously described. In this installation, attachment base lateral edges 45 and 45' of generally planar attachment base 28 are not parallel to arresting tabs 44 and 44' but rather are at a skew angle 76 thereto. Because of the unique construction of the first and second staircase opening means 32 and 51 previously described, coacting with the first and second elongated openings means 16 and 49 which have also been previously described, even though the parts are at a skew angle as just described, it is possible to attach the frame attachment member 27 to the foundation attachment member 9 by placing first and second held-holding fastener means 20 and 50 through first and second staircase opening means 32 and 51 and first and second elongated opening means 16 and 49 respectively at discrete stations 33 and 33'. In the example shown in FIG. 11, the first and second held-holding fastener means 20 and 50 are two stations 33 and 33' apart as opposed to the more standard situation illustrated in FIG. 1 where the frame member 4 and side surface 3 of the foundation 1 are parallel and the discrete stations 33 and 33' are opposite one another and parallel to the frame attachment flange 37. It is to be noted that in the example shown in FIG. 11, lateral attachment side edge 45' of generally planar attachment base 28 is in or near touching engagement with arresting tab 44' at point 77. At the same time, lateral attachment side edge 45 is in or near touching engagement with arresting tab 44 at point 78.

Because no change in the construction of the adjustable foundation plate connector 8 illustrated in FIG. 11 is made which is different from the foundation connector plate 8 illustrated in FIG. 1, no further description is set forth so as to keep the specification as brief as possible. Other numbers which appear on FIG. 11 relate to parts previously described.

Figure 12:
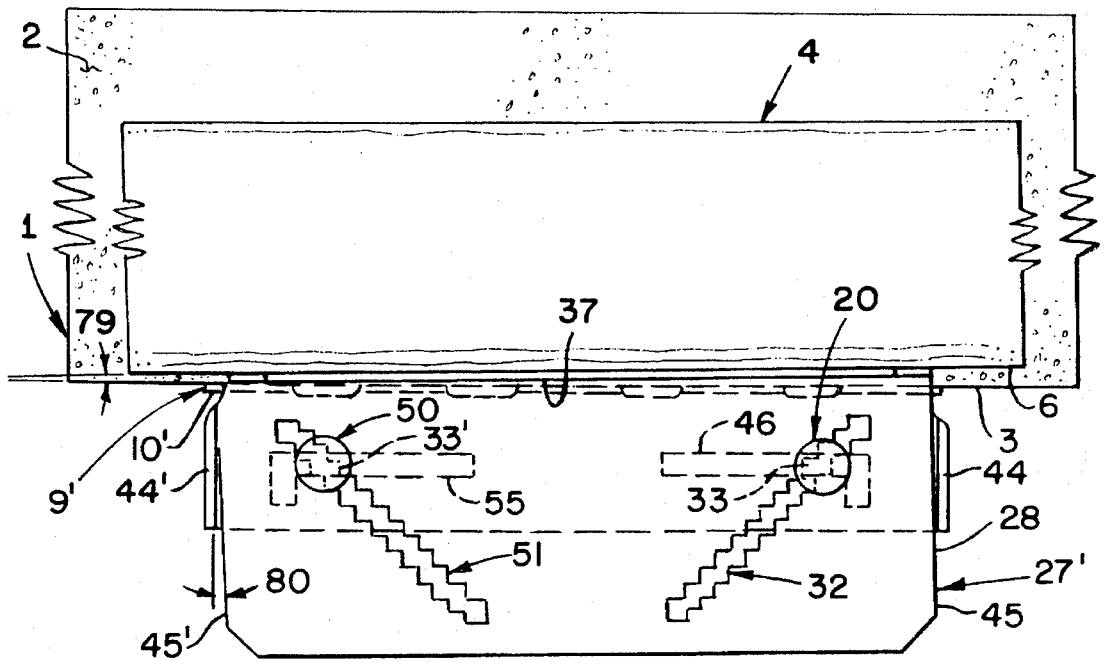
FIG. 12 is a top plan view of the connection formed when the frame member is not in alignment with the side surface of the foundation.

Referring to FIG. 12, another installation situation is illustrated in which the inside edge 6 of frame member 4 is out of alignment with side surface 3 of foundation 1 by an angle 79 indicated by double arrows.

In this installation, foundation adjustment base 10 of foundation attachment member 9 is attached to side surface 3 of foundation 1 as previously described and frame attachment flange 37 of frame attachment member 27 is attached to inside edge 6 of frame member 4 as previously described. In this installation, attachment base lateral edges 45 and 45' of generally planar attachment base 28 are not parallel to arresting tabs 44 and 44' but rather are at a skew angle 80 thereto. Because of the unique construction of the first and second staircase opening means 32 and 51 previously described, coacting with the first and second elongated openings means 16 and 49 which have also been previously described, even though the parts are at a skew angle as just described, it is possible to attach the frame attachment member 27 to the foundation attachment member 9 by placing first and second held-holding fastener means 20 and 50 through first and second staircase opening means 32 and 51 and first and second elongated opening means 16 and 49 respectively at discrete stations 33 and 33'. In the example shown in FIG. 12, the first and second held-holding fastener means 20 and 50 are one station 33 and 33' apart as opposed to the more standard situation illustrated in FIG. 1 where the frame member 4 and side surface 3 of the foundation 1 are parallel and the discrete stations 33 and 33' are opposite one another and parallel to the frame attachment flange 37. Because no change in the construction of the adjustable foundation plate connector 8 illustrated in FIG. 11 is made which is different from the foundation connector plate 8 illustrated in FIG. 1, no further description is set forth so as to keep the specification as brief as possible. Other numbers which appear on FIG. 12 relate to parts previously described.

Note that edge 6 of frame member 4 is very close to edge 3 of foundation 1. This is not a standard installation since in most cases good construction practice requires that the frame member 4 be set back from the inside foundation edge 3.

Figure 13:
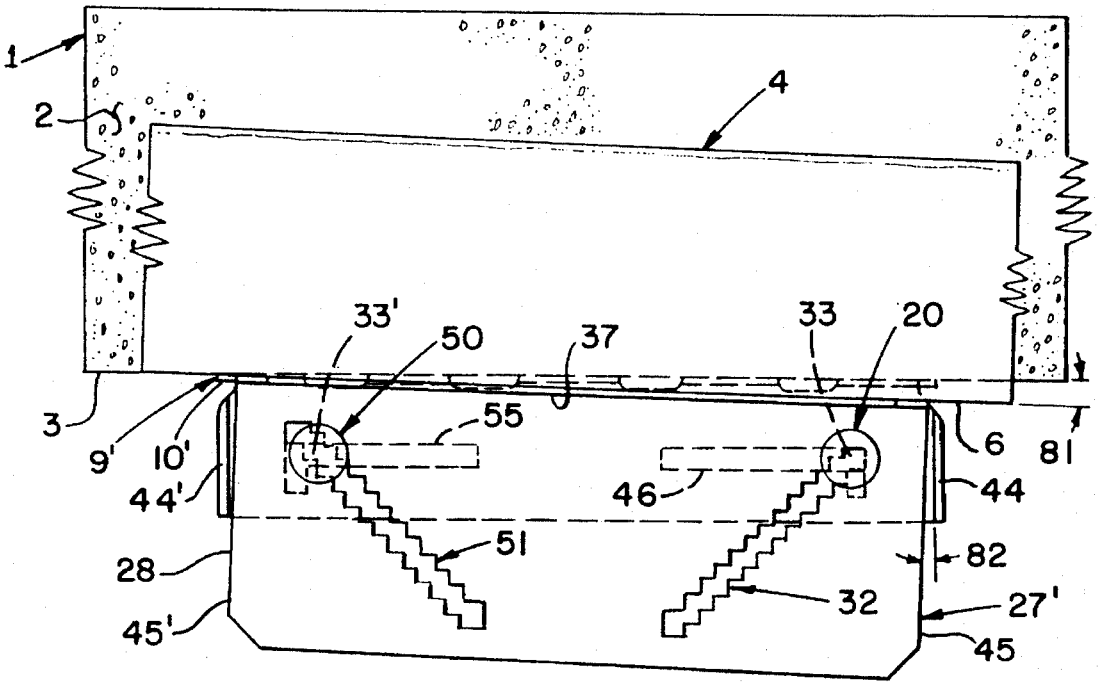
FIG. 13 is a top plan view of the connection formed when the frame member overhangs the side surface of the foundation and is not in alignment with the side surface of the foundation.

FIG. 13 illustrates still another nonstandard situation which is found in some construction in which part of the frame member 4 overlies the foundation 1 and a portion overhangs the foundation 1.

Referring to FIG. 13, inside edge 6 of frame member 4 is out of alignment and also overhangs side surface 3 of foundation 1 by an angle 81 indicated by double arrows.

In this installation, foundation adjustment base 10 of foundation attachment member 9 is attached to side surface 3 of foundation 1 as previously described and frame attachment flange 37 of frame attachment member 27 is attached to inside edge 6 of frame member 4 as previously described. In this installation, attachment base lateral edges 45 and 45' of generally planar attachment base 28 are not parallel to arresting tabs 44 and 44' but rather are at a skew angle 82 thereto. Because of the unique construction of the first and second staircase opening means 32 and 51 previously described, coacting with the first and second elongated openings means 16 and 49 which have also been previously described, even though the parts are at a skew angle as just described, it is possible to attach the frame attachment member 27 to the foundation attachment member 9 by placing first and second held-holding fastener means 20 and 50 through first and second staircase opening means 32 and 51 and first and second elongated opening means 16 and 49 respectively at discrete stations 33 and 33'. In the example shown in FIG. 13, the first and second held-holding fastener means 20 and 50 are one station 33 and 33' apart as opposed to the more standard situation illustrated in FIG. 1 where the frame member 4 and side surface 3 of the foundation 1 are parallel and the discrete stations 33 and 33' are opposite one another and parallel to the frame attachment flange 37.

Because no change in the construction of the adjustable foundation plate connector 8 illustrated in FIG. 13 is made which is different from the foundation connector plate 8 illustrated in FIG. 1, no further description is set forth so as to keep the specification as brief as possible. Other numbers which appear on FIG. 13 relate to parts previously described.

Figure 14:
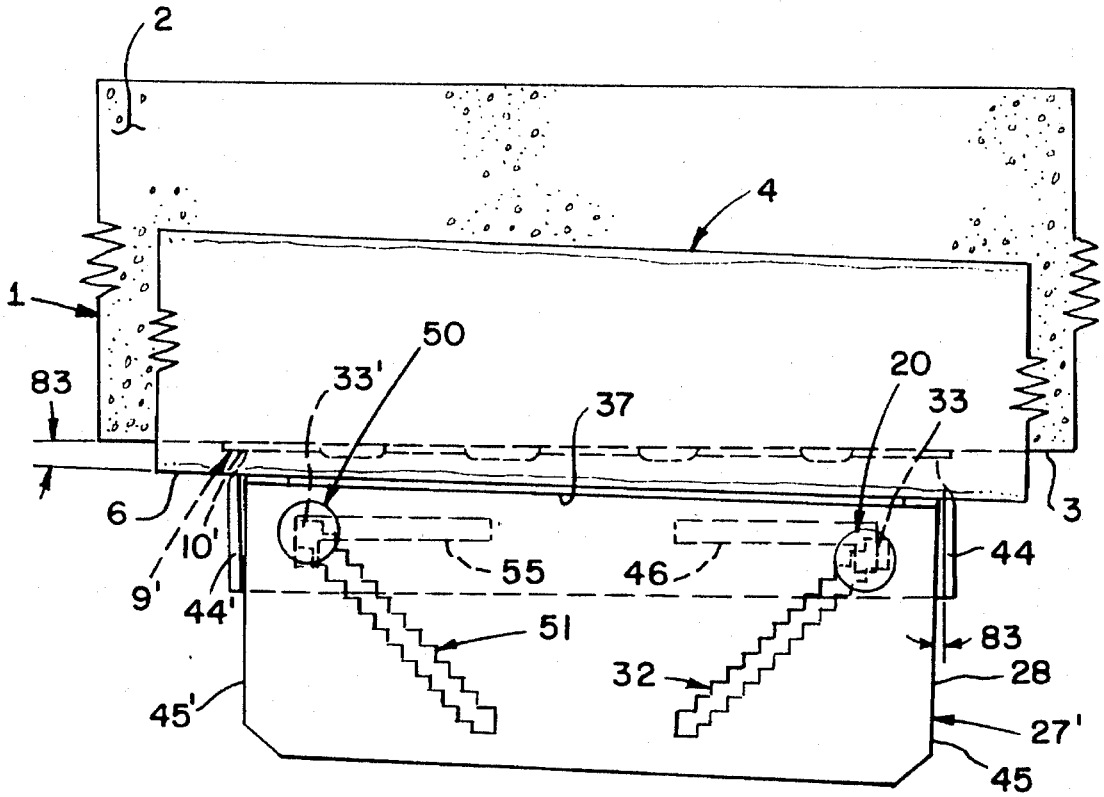
FIG. 14 is a top plan view of the connection formed when the frame member overhangs the side surface of the foundation and is not in alignment with the side surface of the foundation.

Description of FIG. 14

Referring to FIG. 14, the most radical non-standard construction which is occasionally encountered is illustrated in which inside edge 6 of frame member 4 is out of alignment with side surface 3 of foundation 1 by an angle 83 indicated by double arrows. In addition, all portions of inside edge 6 of frame member 4 overhang edge 3 of foundation 1.

In this installation, foundation adjustment base 10 of foundation attachment member 9 is attached to side surface 3 of foundation 1 as previously described and frame attachment flange 37 of frame attachment member 27 is attached to inside edge 6 of frame member 4 as previously described. In this installation, attachment base lateral edges 45 and 45' of generally planar attachment base 28 are not parallel to arresting tabs 44 and 44' but rather are at a skew angle 83 thereto. Because of the unique construction of the first and second staircase opening means 32 and 51 previously described, coacting with the first and second elongated openings means 16 and 49 which have also been previously described, even though the parts are at a skew angle as just described, it is possible to attach the frame attachment member 27 to the foundation attachment member 9 by placing first and second held-holding fastener means 20 and 50 through first and second staircase opening means 32 and 51 and first and second elongated opening means 16 and 49 respectively at discrete stations 33 and 33'. In the example shown in FIG. 13, the first and second held-holding fastener means 20 and 50 are two stations 33 and 33'apart as opposed to the more standard situation illustrated in FIG. 1 where the frame member 4 and side surface 3 of the foundation 1 are parallel and the discrete stations 33 and 33' are opposite one another and parallel to the frame attachment flange 37. Because no change in the construction of the adjustable foundation plate connector 8 illustrated in FIG. 13 is made which is different from the foundation connector plate 8 illustrated in FIG. 1, no further description is set forth so as to keep the specification as brief as possible. Other numbers which appear on FIG. 14 relate to parts previously described.

I claim:

1. An adjustable foundation-to-frame member connection comprising:

a. a foundation, having an upper surface, and a side surface;

b. a frame member, having an upper side, an inside edge, and a lower side, resting on the upper surface of the foundation;

c. an adjustable foundation plate connector including, 1. a foundation attachment member having a foundation attachment base which is formed with foundation attachment opening means and which is formed for substantial registration with said side surface of said foundation, said foundation attachment member having guide means, and a generally planar attachment flange integrally connected to said foundation attachment base, said generally planar attachment flange having a top surface, and an elongated opening means, 2. a held-holding fastener means releasably received by said elongated opening means, said held-holding fastener means having a fastener axis, a distal-end threaded shank portion, a shank formed with a head, and a head-end shank portion formed with two similarly dimensioned pairs of opposing sides, 3. a frame attachment member having a generally planar attachment base, said generally planar attachment base having an attachment base lateral axis, an attachment base longitudinal axis, and a bottom surface, a portion of said bottom surface of said generally planar attachment base is in registration with said top surface of said generally planar attachment flange, with said guide means of said foundation attachment member substantially aligning said frame attachment member with said foundation attachment member and preventing substantial displacement of said generally planar attachment base in relation to said generally planar attachment flange along said attachment base lateral axis, said generally planar attachment base is also formed with a staircase opening means, said staircase opening means formed from a series of interconnected similar stations, one of said similar stations releasably receiving said held-holding fastener means in close registration along a portion of both of said pairs of opposing sides of said head-end shank portion such that substantial rotational, lateral and longitudinal displacement between said held-holding fastener means and said frame attachment member is prevented, said staircase opening means formed to substantially correspond in length and position along said attachment base lateral axis to the length and position of said elongated opening means along said attachment base lateral axis when said frame attachment member is received by said guide means such that wherever said held-holding fastener means are received by said staircase opening means along said attachment base lateral axis said held-holding fastener means are also received by said elongated opening means along said attachment base lateral axis, said staircase opening means having a staircase axis positioned at a selected angle to said attachment base longitudinal axis such that said stations occur at closely-spaced, selected positions along said attachment base longitudinal axis, allowing for an adjustable connection of said foundation attachment member to said frame attachment member that accommodates differences in the spatial relation between said side surface of said foundation and said inside edge of said frame member, said frame attachment member also having a frame attachment flange which is integrally connected to said generally planar attachment base and disposed for registration with said inside edge of said frame member and which is formed with frame member attachment opening means, 4. and a holding means releasably connected to said distal-end threaded shank portion of said held-holding fastener means, said holding means and said head of said held-holding fastener means formed to prevent said held-holding fastener means from passing through both said elongated opening means and said staircase opening means when said held-holding fastener means is received thereby, and said holding means and said head of said held-holding fastener means also preventing movement of said frame attachment member and said foundation attachment member along said fastener axis;

d. frame fastener means that are received in close registration by said frame member attachment opening means and secure said frame attachment member to said frame member; and e. foundation fastener means that are received in close registration by said foundation attachment opening means and secure said foundation attachment member to said foundation.

2. An adjustable foundation-to-frame member connection as described in claim 1, wherein a. said generally planar attachment flange is formed with a second elongated opening means;

b. said adjustable foundation plate connector includes a second held-holding fastener means, said second held-holding fastener means releasably received by said second elongated opening means, said second held-holding fastener means having a fastener axis, a distal-end threaded shank portion, a shank formed with a head, and a head-end shank portion formed with two similarly dimensioned pairs of opposing sides;

c. said generally planar attachment base is formed with a second staircase opening means, said second staircase opening means formed from a series of interconnected similar stations, one of said similar stations releasably receiving said second held-holding fastener means in close registration along a portion of both said pairs of opposing sides of said head-end shank portion such that substantial rotational, lateral and longitudinal displacement between said second held-holding fastener means and said frame attachment member is prevented, said second staircase opening means formed to substantially correspond in length and position along said attachment base lateral axis to the length and position of said second elongated opening means along said attachment base lateral axis when said frame attachment member is received by said guide means such that wherever said second held-holding fastener means are received by said second staircase opening means along said attachment base lateral axis said second held-holding fastener means are also received by said second elongated opening means along said attachment base lateral axis, said second staircase opening means having a second staircase axis positioned at a selected angle to said attachment base longitudinal axis such that said stations occur at closely-spaced, selected positions along said attachment base longitudinal axis, allowing for an adjustable connection of said foundation attachment member to said frame attachment member that accommodates differences in the spatial relation between said side surface of said foundation and said inside edge of said frame member; and d. said adjustable foundation plate connector includes a second holding means, said second holding means releasably connected to said distal-end threaded shank portion of said second held-holding fastener means, said second holding means and said head of said second held-holding fastener means formed to prevent said second held-holding fastener means from passing through both said second elongated opening means and said second staircase opening means when said second held-holding fastener means is received thereby, and said second holding means and said head of said second held-holding fastener means also preventing movement of said frame attachment member and said foundation attachment member along said fastener axis of said second held-holding fastener means.

3. An adjustable foundation-to-frame member connection as described in claims 1 or 2, wherein:

a. said guide means are formed as arresting tabs integrally connected to said generally planar attachment flange; and b. said generally planar attachment base is formed with attachment base lateral side edges dimensioned such that when a portion of said bottom surface of said generally planar attachment base is in registration with said top surface of said generally planar attachment flange, said arresting tabs align the frame attachment member with the foundation attachment member and prevent substantial displacement of the generally planar attachment base in relation to the generally planar attachment flange along the attachment base lateral axis.

4. An adjustable foundation-to-frame member connection as described in claim 1, wherein said elongated opening means is formed as an opening running generally parallel to said attachment base lateral axis, when said frame attachment member is attached to said foundation attachment member by said held-holding fastener means.

5. An adjustable foundation-to-frame member connection as described in claim 1, wherein said elongated opening means is formed as an "L"-shaped opening means, allowing said held-holding fastener means to be received by said generally planar attachment flange at a distance away from said side surface of said foundation that accommodates applications where said inside edge of said frame member extends beyond said side surface of said foundation.

6. An adjustable foundation-to-frame member connection as described in claim 1, wherein said guide means, said lateral side edges, said similar stations, said pairs of opposing sides of said head-end shank portion of said held-holding fastener means, and said elongated opening means are formed to accommodate applications where said side surface of said foundation and said inside edge of said frame member are not in alignment.

7. An adjustable foundation-to-frame member connection as described in claim 2, wherein said elongated opening means and said second elongated opening means are formed as openings running generally parallel to said attachment base lateral axis, when said frame attachment member is attached to said foundation attachment member by said held-holding fastener means and said second held-holding fastener means.

8. An adjustable foundation-to-frame member connection as described in claim 2, wherein said elongated opening means and said second elongated opening means are formed as an "L"-shaped opening means and a second "L"-shaped opening means, allowing said held-holding fastener means and said second held-holding fastener means to be received by said generally planar attachment flange at a distance away from said side surface of said foundation that accommodates applications where said inside edge of said frame member extends beyond said side surface of said foundation.

9. An adjustable foundation-to-frame member connection as described in claim 2, wherein said guide means, said lateral side edges, said similar stations, said second similar stations, said pairs of opposing sides of said head-end shank portion of said held-holding fastener means, and said elongated opening means are formed to accommodate applications where said side surface of said foundation and said inside edge of said frame member are not in alignment.

* * * * *